US008034306B1

(12) United States Patent
Grudzien et al.

(10) Patent No.: US 8,034,306 B1
(45) **Date of Patent: *Oct. 11, 2011**

(54) REACTION SURFACE ARRAY DIAGNOSTIC APPARATUS INCLUDING A FLEXIBLE MICROTITRE PLATE

(75) Inventors: Jennipher Grudzien, Metamora, MI (US); Charles McGrath, Bend, OR (US)

(73) Assignee: Grace Bio-Labs, Inc., Bend, OR (US)

( * ) Notice: Subject to any disclaimer, the term of this patent is extended or adjusted under 35 U.S.C. 154(b) by 834 days.

This patent is subject to a terminal disclaimer.

(21) Appl. No.: 11/236,979

(22) Filed: Sep. 28, 2005

Related U.S. Application Data

(63) Continuation-in-part of application No. 10/784,092, filed on Feb. 20, 2004, now Pat. No. 7,731,909.

(51) Int. Cl.
*B01L 3/00* (2006.01)

(52) U.S. Cl. ..... 422/553; 422/552; 422/560; 422/561; 422/562; 422/563

(58) Field of Classification Search ..... 422/102, 422/104; 435/288.4; 40/701, 781, 766; 449/10; 257/433, 434; 362/633, 634
See application file for complete search history.

(56) References Cited

U.S. PATENT DOCUMENTS 3,726,754 A 4/1973 Coglianese et al.
3,726,767 A 4/1973 White
3,745,091 A 7/1973 McCormick
3,883,398 A 5/1975 Ono
4,039,247 A 8/1977 Lawman et al.
4,299,920 A 11/1981 Peters
4,682,890 A 7/1987 de Macario et al.
5,192,503 A 3/1993 McGrath et al.
5,342,581 A * 8/1994 Sanadi ..... 422/101
5,424,213 A 6/1995 Mougin
5,571,721 A 11/1996 Turner
5,591,646 A * 1/1997 Hudson et al. ..... 506/9
5,800,785 A 9/1998 Bochner
5,972,694 A 10/1999 Mathus
6,096,562 A 8/2000 Bunn et al.
6,225,109 B1 * 5/2001 Juncosa et al. ..... 435/288.5
6,277,629 B1 8/2001 Wolf et al.
6,376,233 B1 4/2002 Wolf et al.
6,426,050 B1 7/2002 Pham et al.
6,436,050 B2 8/2002 Garrison et al.
6,436,351 B1 8/2002 Gubernator et al.
(Continued)

OTHER PUBLICATIONS

Mendoza et al., "High-Throughput Microarray-Based Enzyme-Linked Immunosorbent Assay (ELISA)", BioTechniques 27: 778-788, Oct. 1999.

(Continued)

*Primary Examiner* — Natalia Levkovich
(74) *Attorney, Agent, or Firm* — Alleman Hall McCoy Russell & Tuttle LLP

(57) ABSTRACT

A reaction surface array diagnostic apparatus includes a substrate carrying a plurality of reaction surfaces and, a plate having a plurality of wells, alignable with one of the reaction surfaces and forming a fluid tight well about each reaction surface when the plate and the substrate are sealingly affixed to each other in a frame. The plate is formed of a flexible material which may have an adhesive on one surface. Interlocking latch members are formed on the plate and the frame for releasably latching the plate and the frame in a position for sealing attachment to the substrate.

19 Claims, 8 Drawing Sheets

U.S. PATENT DOCUMENTS

| | | | | |
|---|---|---|---|---|
| 6,485,690 | B1 * | 11/2002 | Pfost et al. | 422/102 |
| 6,669,911 | B1 * | 12/2003 | Swanson | 422/102 |
| 7,063,979 | B2 * | 6/2006 | MacBeath et al. | 435/305.2 |
| 2001/0001644 | A1 | 5/2001 | Coffman et al. | |
| 2001/0007642 | A1 | 7/2001 | Feiglin | |
| 2002/0141905 | A1 | 10/2002 | Sha et al. | |

OTHER PUBLICATIONS

*Secure-Seal Hybridization Chambers*, Grace Bio-Labs, Inc., PO Box 228, Bend, OR 97709, publication date May 22, 2000.

*CultureWell MultiWell Coverslip Cell Culture Inserts*, Grace Bio-Labs, Inc., PO Box 228, Bend, OR 97709, publication date 2000.

*CultureWell MultiSlip & SecureSlip*, Grace Bio-Labs, Inc., PO Box 228, Bend, OR 97709, publication date May 22, 2001.

Corning, *Hybridization Chamber*, product description, publication date unknown.

TeleChem International, Inc., *Hybridization Cassettes Handbooks*, product description, publication date unknown.

MWG Biotech Inc., *Hybridization Chamber*, product description, publication date unknown.

Genetix, *Genetix Hybridization Chamber*, product description, publication date unknown.

* cited by examiner

REACTION SURFACE ARRAY DIAGNOSTIC APPARATUS INCLUDING A FLEXIBLE MICROTITRE PLATE

CROSS REFERENCE TO CO-PENDING APPLICATION

This application is a continuation-in-part of co-pending U.S. patent application Ser. No. 10/784,092, filed Feb. 20, 2004, which is a continuation-in-part of co-pending U.S. patent application Ser. No. 10/349,347 filed Jan. 22, 2003 which claims the benefit of U.S. provisional patent application No. 60/351,008, filed Jan. 22, 2002, the contents of each of which are incorporated herein in their entirety.

BACKGROUND

In situ diagnostic techniques have evolved into a high speed, highly automated process. Standard size test chambers in the form of microarrays of columns and rows of individual wells are formed by means of a microtitre plate or plates on a substrate to which the microtitre plate(s) is attached. The standard matrix of columns and rows is available in different sizes to suit different automated equipment. However, a common format is the use of microarrays on 1 mm thick, 25 mm×75 mm glass microscope slides.

The standard microtitre plate is approximately 86 mm×128 mm. Wells in microtitre plates are provided with standard spacing, such as a 9 mm spacing in a 96 well plate, which has the wells arranged in 12 columns and 8 rows. A 4.5 mm spacing between the centers of adjacent wells is used in a 384 well plate which has the wells arranged in 24 columns and 16 rows. A 2.25 mm spacing is used in a 1536 well plate, with the wells arranged in 48 columns and 32 rows.

It would be desirable to provide a simple and expedient means for creating a plurality of reaction surfaces on microscope slides in the footprint of a standard microtitre plate for use in automated in situ diagnostic apparatus. It would also be desirable to provide a reaction surface array diagnostic apparatus which provides an easy assembly of the individual apparatus components; yet an assembly which is easily disassembled. It would also be desirable to provide a reaction surface array diagnostic apparatus which includes means for securely retaining the apparatus components together during use.

SUMMARY

The present invention is a reaction surface array diagnostic apparatus having a flexible plate with a plurality of wells. At least one substrate is provided with a plurality of reaction surfaces. A holder fluidically joins the plate to the substrate.

At least one latching element is carried on the plate for joining the plate to the holder. A complementary latching member is carried on the holder for receiving the at least one latching element on the plate.

The at least one latching element and the least one latching member include a complementary shaped tab and channel. The tab can be carried on the plate. The channel can be carried on the holder.

The at least one latching element may include a plurality of latching elements carried on a periphery of the plate and a plurality of latch members carried on the holders.

In one aspect, the plate and the holder have a plurality of complementary sides and the at least one latching element and the at least one latching member include at least one latching element and at least one latching member formed on one pair of opposed sides of the plate and the holder.

A non-releasable adhesive can be used to fixedly joining the plate to the substrate.

The holder may have exterior dimension of about 86 mm×128 mm.

The reaction surface array diagnostic apparatus provides an expedient means for simultaneously conducting reactions on a plurality of reaction surfaces. The use of the flexible plate with bores and a substrate carrying the reaction surfaces forms fluid tight reaction chambers or wells about each reaction surface merely by mounting the plate and the substrate in the holder.

BRIEF DESCRIPTION OF THE DRAWING

The various features, advantages and other uses of the present invention will become more apparent by referring to the following detailed description and drawing in which.

DETAILED DESCRIPTION

Figure 1:
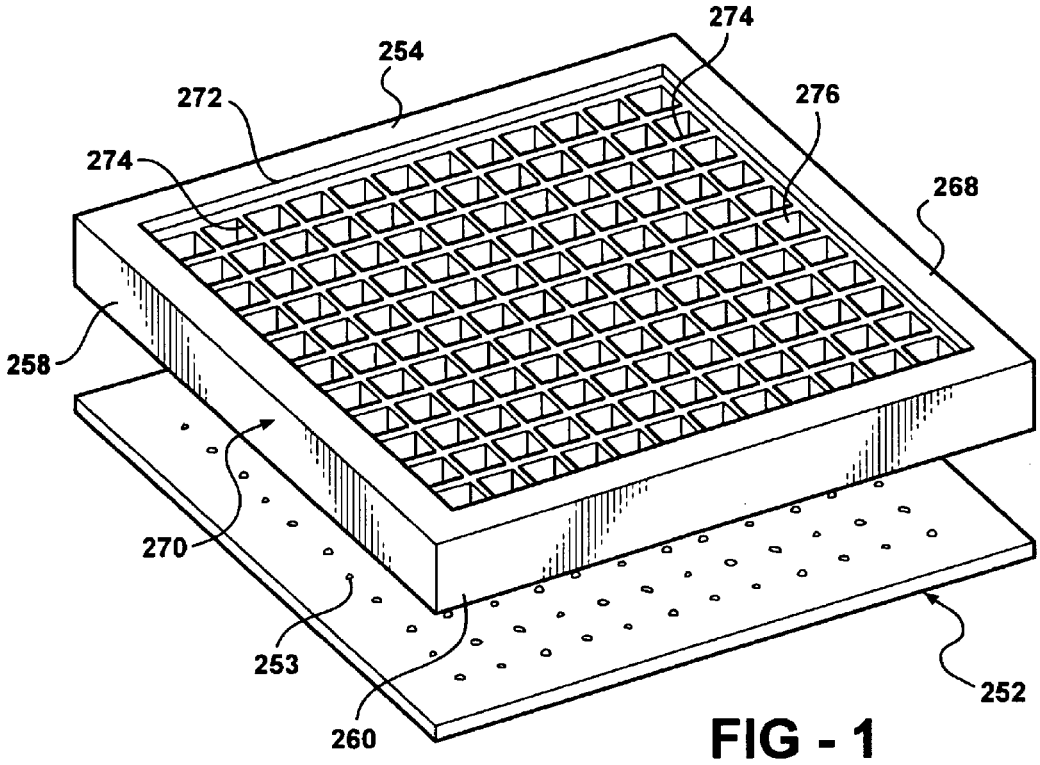
FIG. 1 is an exploded perspective view of a reaction surface array diagnostic apparatus having a flexible microtitre plate.

The present invention is a reaction surface array diagnostic apparatus which creates a plurality of reaction surfaces on substrates, microscope slides, etc., in the footprint of a standard microtitre plate.

In the following description, a substrate 22, shown in FIGS. 1-4 will be understood to be one or more standard sized (1"×3") (25 mm×75 mm) microscope slide(s). In a preferred example, the substrate 252 has the exterior dimensions of slightly smaller than a 96 well plate (86 mm×128 mm) or four microscope slides, in a side-by-side array. The slides can be microscope slides formed of either glass or plastic, with generally transparent materials being preferred. The slides are rigid and are not readily flexible.

A plurality of reaction surfaces 253 are formed on the substrate 252. The reaction surfaces 253 can be in the form of an array of microporous films, such as nitrocellulose films, or other films, for example only, or treated glass surfaces, such as glass treated with a protein binding solution. The reaction surfaces 253 are fixed in position on one surface of each substrate 252 in a standard microarray. For example, the microporous or nitrocellulose films 253 are spun cast onto the surface of each substrate 252 in the form of droplets and allowed to dry.

The microporous films 253 which act as molecular binding or reaction areas on each substrate 252 have a center-to-center spacing based on 9 mm in both the vertical and horizontal directions. A 9 mm spacing between reaction areas create 96 reaction areas that fit in the footprint of a microtitre plate. A 4.5 mm center-to-center spacing gives 384 areas in the footprint of a microtitre plate.

Reaction chambers are formed about each reaction surface 253 to provide chambers for receiving cells, proteins, antibodies, nucleic acid and other reaction elements for reaction with the films or treated areas 253. The reaction chambers are formed, according to the present invention, by a gasket 250, such as a silicone gasket, which has a plurality of through bores or wells 274 arrayed in the same 9 mm or 4.5 mm vertical and horizontal array spacing as the reaction surfaces 253 as a microtitre plate. This allows each through bore or well 274 to align with and surround one reaction surface 253 on the substrate 252. The use of the silicone as the material to form the gasket 250 secures the reaction chambers in a stationary, non-movable position on each substrate 252 about the reaction surfaces 253 due to the inherent sticky, but releasible nature of silicone.

Alternately, a non-releasible adhesive, not shown, such as an acrylic adhesive, is disposed between the gasket 250 and the substrate 252 to fix the gasket 250 to the substrate 252.

It is also feasible in the present invention to fluidically link two, three or more adjacent wells 274 together by small diameter flow channels extending through the gasket 250 between the wells 274. Any number and arrangement of wells 274 may be fluidically coupled in the gasket 250 while still retaining the preset center-to-center spacing between the wells 274.

At the same time, the thickness of the gasket 250 may be varied or multiple gaskets may be stacked one on top of the other to provide a pre-determined reaction chamber or well depth for a particular volume of reactant.

The use of the gasket 250 to form the reaction chambers also prevents leaking between adjacent reaction chambers since the gasket 250 seals to the substrate 252 to isolate each reaction surface 253 from adjacent reaction surfaces 253.

Gasket thicknesses of about 0.5 mm to 2.5 mm can be used. The overall shape of the gasket 250 approximate the shape or the plate 112 and the substrate 252.

Inherent physical and chemical characteristics of the silicone gasket 250 enables the gasket 250 to be non-moveably yet releasably secured to the substrate 252 and, as well, to fixedly yet releasably attach the surface of the substrate 252 to the gasket 250 through non-mechanical, short range acting forces, such as electrostatic forces, Van der Waal forces, etc. This cohesiveness is typically sufficient to retain plate or the gasket 250 in secure watertight engagement with the substrate 252 to prevent cross flow or fluid leakage between the various wells or chambers 274.

Enhanced adhesion can be had by providing a non-releasible adhesive, not shown, such as an acrylic adhesive, which cannot easily be removed from the plate 250, is disposed between the plate 250 and the substrate 252 to fix the gasket 250 to the substrate 252.

Referring now to FIGS. 1-4, there is depicted gasket formed as a large, single piece, unitary microtitre plate 250 or gasket. The plate 250 is formed to be flexible so as to be easily applied to and removed from the substrate 252.

The microtitre plate 250 has the overall exterior dimensions of a microtitre plate or approximately 86 mm×128 mm. This enables the microtitre plate 250 to be processed using pipette and plate washing robotics.

The microtitre plate 250 has a generally polygonal or rectangular configuration with a first upper surface 254, a second lower surface 256 and sidewalls 258, 260, 262, and 264.

Figure 2:
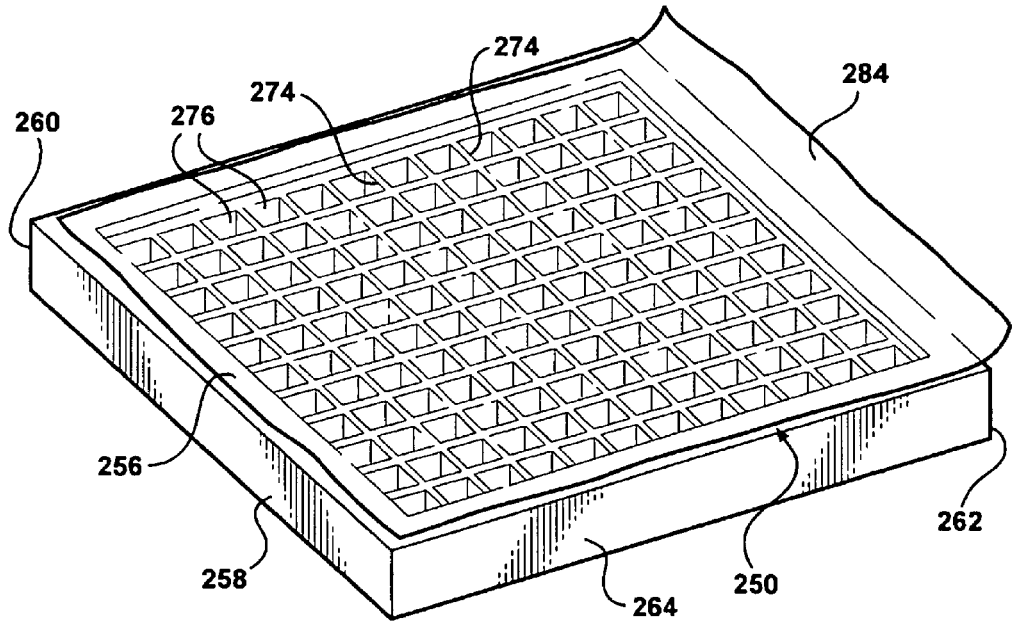
FIG. 2 is a perspective view of the bottom of the apparatus shown in FIG. 1.
Figure 3:
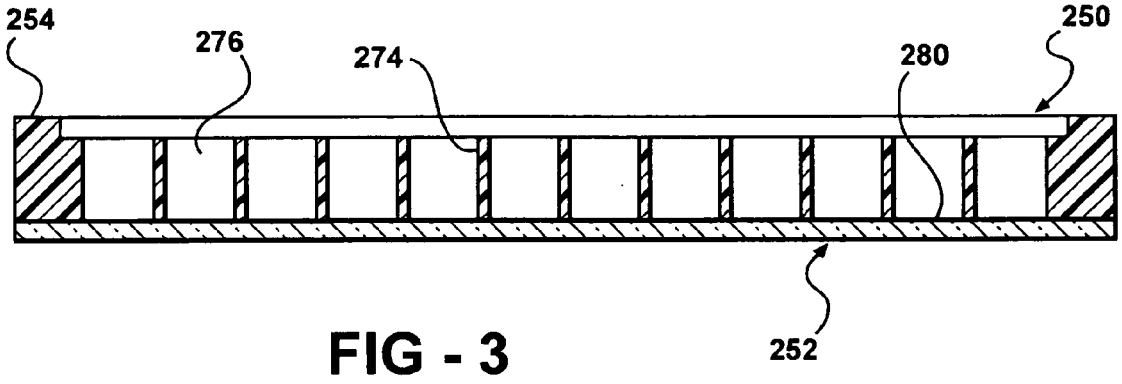
FIG. 3 is a cross sectional view through the joined microtitre plate and substrate.

A generally solid peripheral border denoted generally by reference number 268 extends inward from the sidewalls 258, 260, 262, and 264 and surrounds an inner array 270 of individual wells 272 which are formed by perpendicularly intersecting walls 274. An upper surface 276 of the walls 274 is shown by example as being flush with the top surface 254 of the plate 250. The opposed bottom edge of the walls 276 is also flush with the bottom surface 258, as shown in FIG. 2.

Figure 4:
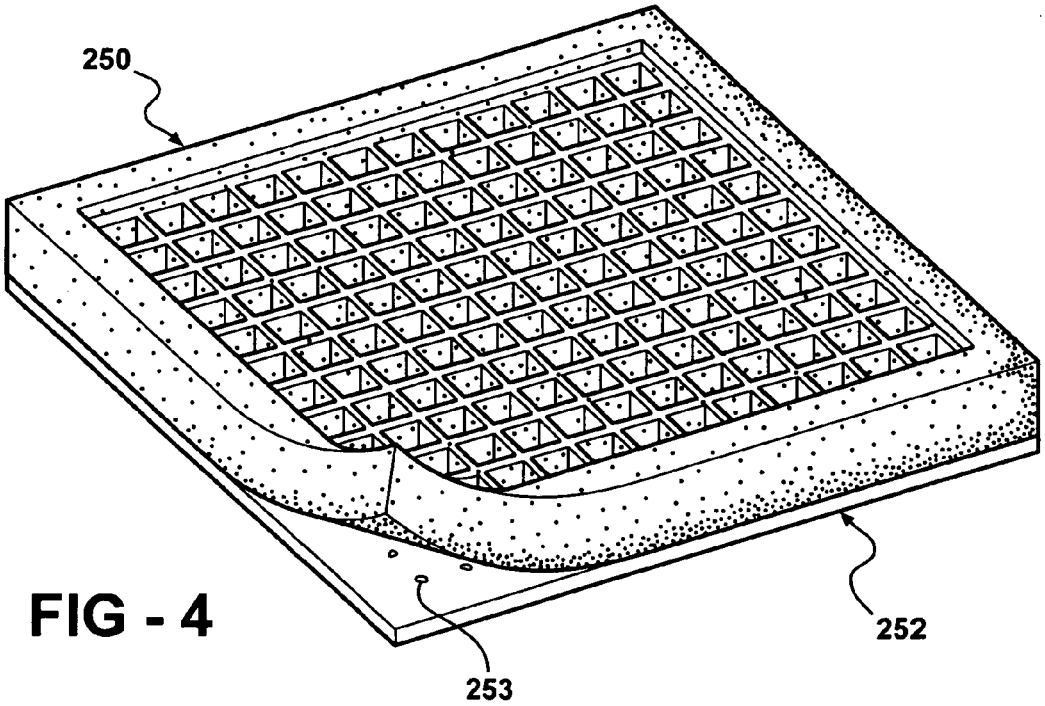
FIG. 4 is a perspective view of the separation of the flexible microtitre plate from the substrate.

The microtitre plate 250 is formed of a flexible material which nevertheless has sufficient rigidity to retain its shape for robotic handling, but can be flexed to assist in separation from the substrate 252, as shown in FIG. 4 and described hereafter. The plate 250 is also formed of a material that is compressible. In one aspect, the microtitre plate 250 is formed of silicone.

The microtitre plate 250 can be formed as a unitary body molded or extruded from silicone or multiple identically formed layers joined together by a non-reversible adhesive, such as a an acrylic/silicone adhesive.

An adhesive 280 maybe applied over the bottom surface 256 covering the peripheral edge and the edges of the walls 276. The adhesive 280 may be a releasible adhesive, such as a double sided silicone/acrylic adhesive tape. The adhesive 280 forms a reversible, separable bond with the substrate 252 which typically is formed of a rigid material, such as glass or plastic.

In use, the microtitre plate 250 is positioned with the first, upper surface 252 in a downward facing direction. A release cover 284 is removed from the opposed lower surface 256 exposing the adhesive layer 280. The substrate 252 carrying reaction surfaces or microarrays 253 arranged in a microtitre plate well spacing, is then placed in contact with the adhesive 280 on the lower surface 256 of the microtitre plate 250 with of the edges of the substrate 252 aligned with the peripheral edges of the microtitre plate 250 to ensure that each reaction surface or microarray 253 on the substrate 252 is aligned with one of the wells 274 in the microtitre plate 250. The microtitre plate 250 and the substrate 252 are now in condition for processing.

After processing is complete, the microtitre plate 250 can be separated from the substrate 252 by lifting one edge of the microtitre plate, as seen in FIG. 4, from the substrate 252 and then pulling and de-coupling the microtitre plate 250 from the remainder of the substrate 252.

FIGS. 5-8 depict another aspect of a diagnostic apparatus 300. In this aspect, the apparatus 300 is formed similarly to the apparatus 250 described above and shown in FIGS. 1-4 in that the microtitre plate 302 is formed of a flexible material, such as a flexible silicone, with wells arranged in a microtitre configuration and center-to-center spacing.

In this aspect, the plate 302 has the layer of adhesive applied to one surface of the wells and the peripheral boundary of the plate 302 as described above.

In a unique feature, a pad or lip 304 having the same exterior peripheral shape and dimensions as the exterior of the microtitre plate 302 is applied over one surface of the plate 302. The pad 304 has an interior aperture 306 sized to expose all of the wells in the microtitre plate 302. For example, the pad 304 may have the same interior dimensions, such as 6 mm on the long sides and 9 mm on the shorter sides, as does the peripheral boundary of the microtitre plate 302.

Figure 5:
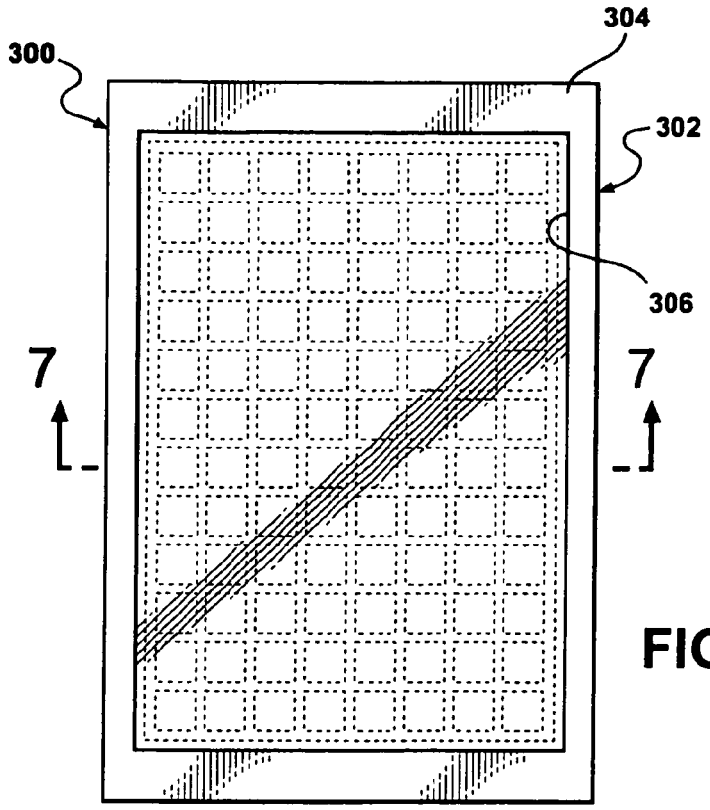
FIG. 5 is a plan elevational view of another aspect of a microtitre plate used in the diagnostic apparatus of the present invention.
Figure 6:
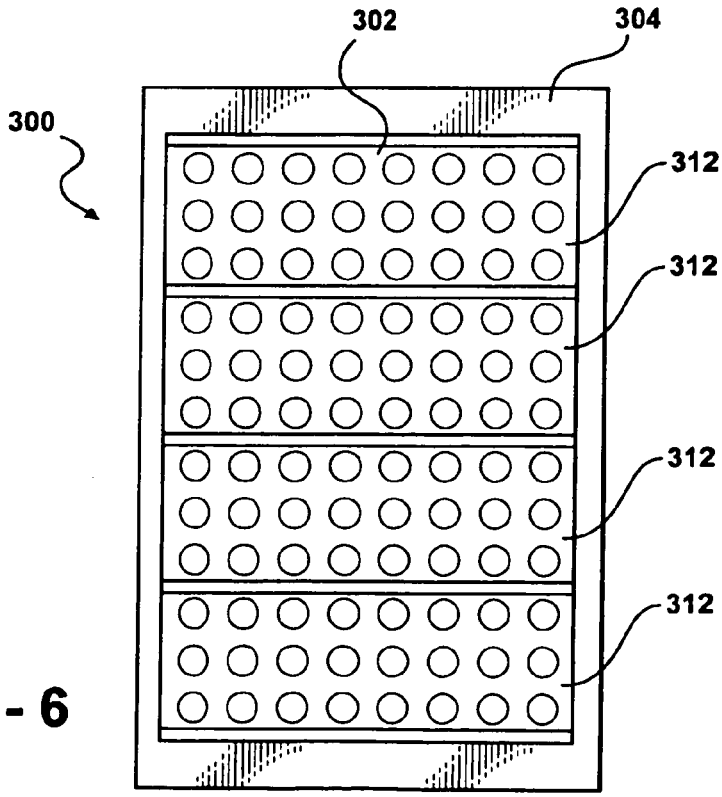
FIG. 6 is a cross sectional view generally taken along line 6-6 in FIG. 5.
Figure 8:
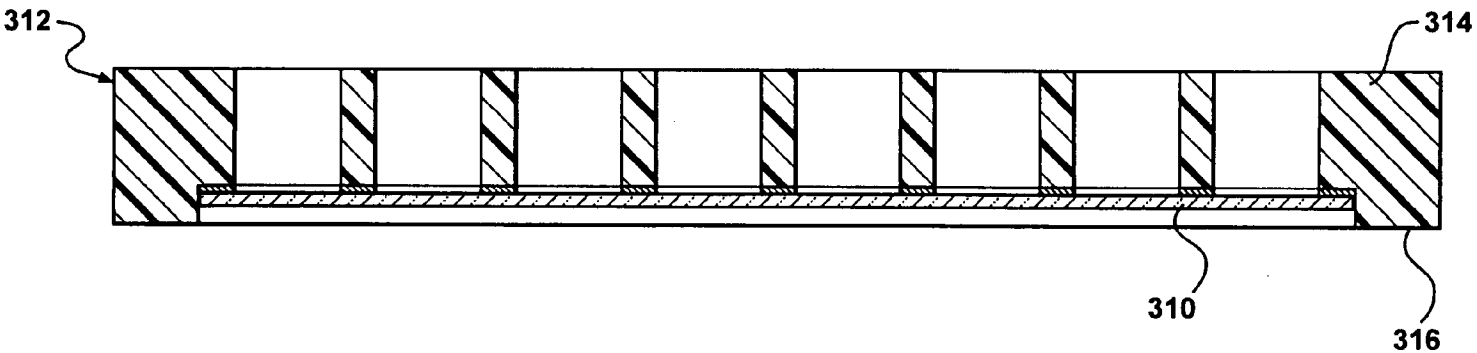
FIG. 8 is a plan elevational view showing the use of multiple substrates with a single microtitre plate according to the present invention.
Figure 9:
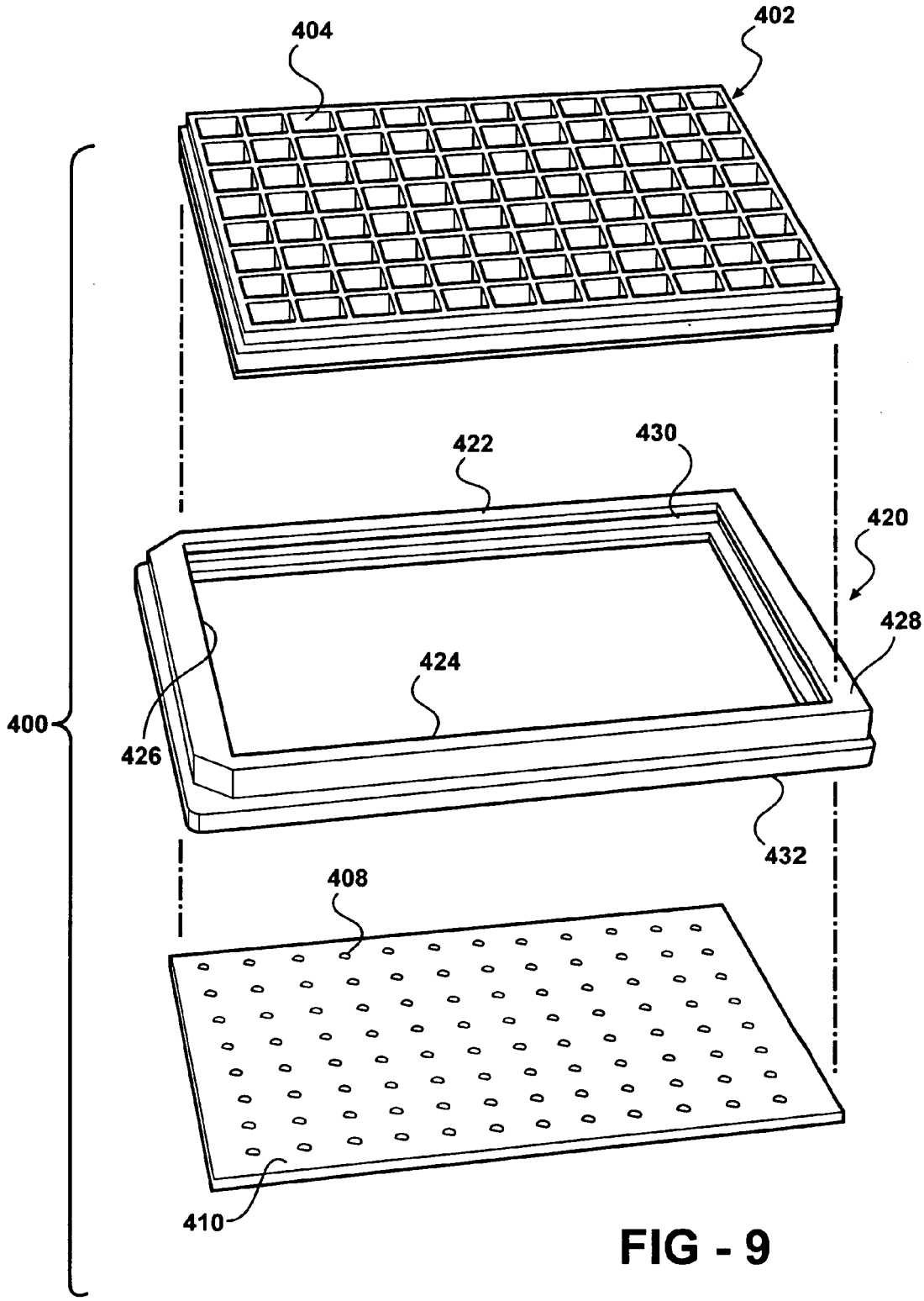
FIG. 9 is an exploded perspective view of another aspect of a reaction surface array diagnostic apparatus having a flexible microtitre plate.

As the pad 304 is a separate element from the microtitre plate 302, it is non-releasably fixed to the plate 302 by means of the adhesive 308 applied to one surface of the microtitre plate 302. As shown in FIGS. 5 and 6, the pad 304 forms an interior recess in the aperture 306 therein which is sized to receive a substrate 310, such as a large glass plate, two smaller plates or, as shown in FIG. 8, four substantially identical substrates, such as glass slides 312.

The substrate 310 will fit snugly within the aperture 306 and the pad 304 and be releasably secure to the adhesive layers 308.

Preferably, the pad 304 is formed of the same flexible material as that used to form the plate 302. For example, both the pad 304 and the plate 302 could be formed of flexible silicone. This enables the pad 304 and the plate 302 to be flexed at one edge, as shown in the earlier aspect depicted in FIG. 4, and then slowly peeled away from the substrate 310.

The inherent attractive forces between the pad 304 and the plate 302 and the substrate 310 enable short range acting forces, such as electrostatic forces and Van der Waal forces, among others, to come into play when the two surfaces are brought into close proximity or contact to releasably fix the two surfaces together. Separation is readily implemented as described above to break the short range acting forces between the two surfaces.

It will be understood that the short range acting forces are non-mechanical forces, excluding clamps or clips, and does not involve the use of chemical adhesion.

It is should also be noted that the depth or height of the pad 304 is greater than the thickness of the substrate 310 so as to recess the substrate 310 completely within the interior of the aperture 306 and the pad 304 as shown in FIG. 6.

Figure 7:
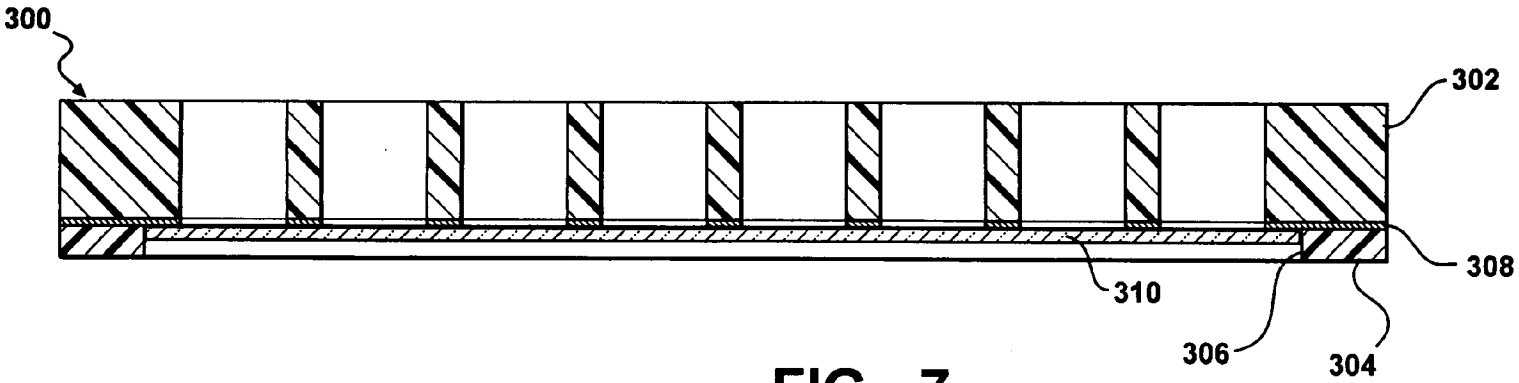
FIG. 7 is an enlarged cross sectional view, generally similar to FIG. 6, but depicting another aspect of a homogeneously formed pad/lip and microtitre plate.

In FIG. 7, the pad 304 described above is depicted as being homogeneously and integrally formed as part of a microtitre plate 314. The pad 304 in this aspect forms a lip 316 on one surface of the plate 314. The use and removal of the apparatus 312 shown in FIG. 7 is the same as that described above for the diagnostic apparatus 300 described in conjunction with FIGS. 5 and 6.

In FIG. 8, there is depicted a different substrate in which the substrate is formed of four substantially identical substrates, such as standard sized microscope slides. Each slide is reversibly adhesively sealed to one surface of the wells in the microtitre plate 302 or 314 and recessed within the aperture within the pad 304 or the lip extension 316.

One advantage of forming the entire plate 302 or 314 and the pad adhesively fixed or unitarily formed therewith of a flexible material, such as a flexible and compressible silicone is that the substrate 310 or 312 can be forced against one surface of the wells of the microtitre plate compressing the plate so as to ensure a leak proof seal between the substrate 310 or 312 and the surfaces of the plate between adjoining wells.

Referring now to FIGS. 9-15, there is depicted another aspect of a reaction surface diagnostic apparatus 400. The apparatus 40 includes a flexible gasket 402 generally similar to the gasket or flexible microtitre plate 250. By example, the gasket or plate 402 is formed of a flexible material, such as silicone.

The gasket 402, which could be formed of a plurality of side-by-side arranged smaller gaskets, has a plurality of internal wells 404 arranged on a center-to-center steel spacing consistent with microtitre plate processing. Thus, the gasket or plate 402 may have 96 wells, 384 wells, etc.

The wells 404 are alignable with and form reservoirs or reaction chambers about individual reaction surfaces 408 deposited on a substrate 410. The substrate 410 may be formed as a single substrate of a suitable reaction array processing material, such as glass, plastic, etc., with transparent materials being better for in situ processing.

Alternately, the substrate 410 may be formed of a plurality of side-by-side arranged smaller substrates.

The apparatus 400 also includes a holder or frame 420 which releasably receives the gasket 402 and the substrate 410.

The holder or frame 420 may be formed as a single piece, molded body, or as a unitary structure formed of a number of fixedly joined sections, each of a rigid material, such as a rigid substantially non-bendable plastic, such as ABS, polycarbonate, etc.

The holder 420 has an exterior footprint equal to the footprint of a standard microtitre plate for processing in the same manner as a microtitre plate.

Thus, the holder 420 includes opposed long sides 422 and 424 and intervening and interconnected short sides 426 and 428. The holder 420 also has a top or upper surface 430 and a bottom or lower surface 432. The terms "top or upper" and "bottom or lower" are used with respect to orientation in reaction surface array processing.

Interconnecting means are provided for releasably locking the gasket 402 in the holder 420. By example only, the interconnecting means includes laterally outward extending tabs, such as a continuous tab 436 shown in FIGS. 11-13A, which extends completely along the periphery of the two opposed sides 422, 424, 426, and 428 of the gasket 402. The tabs 436 generally have an overall height dimension less than the overall height of the gasket 402, such as the two short sides.

The interconnecting means could also be a function or fit of the plate or gasket 402 and the holder 420, or fixing the plate 402 to the substrate 410.

Also, the tabs 436 may be discontinuous forming spaced segments along each side 426.

A complimentarily shaped channel or slot 438 is formed in the interior of two sides 426, and 428 of the holder 420. An open end of the channel faces inward toward to the channel in the opposed side 428 or 426 of the holder 420.

Figure 13A:
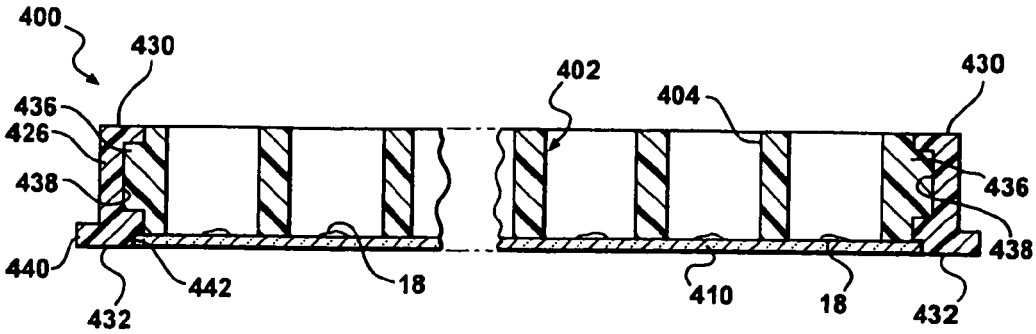
FIG. 13A is a cross-sectional view of the assembled apparatus generally taken along line 13-13 in FIG. 10.
Figure 13B:
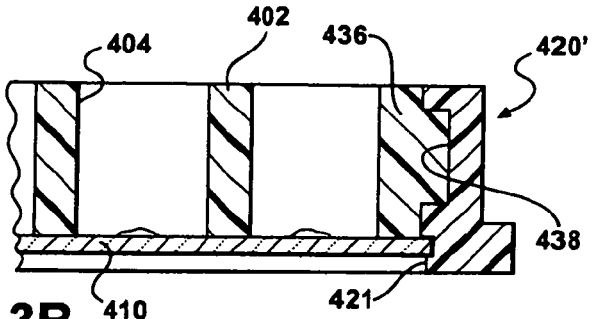
FIG. 13B is a cross-sectional, similar to FIG. 13A, but showing a modification to the apparatus.

In FIG. 13B, the holder 420' is a slightly modified version of the holder 420. The holder 420' includes an inward extending lip 421 adjacent the bottom surface 432. The lip 421 defines an inner opening in the holder 420' that is slightly smaller than the overall dimensions of the substrate 410 to enable the substrate 410 to be dropped into the holder 420' from the top by itself or after joined or to the gasket or plate 402. This arrangement enables both the substrate 410 and the plate 402 to be joined together and/or inserted through the same side of the holder 420', with the substrate 410 held in a generally flat or planar shape in the holder 420—through engagement with the lip 421.

Figure 13C:
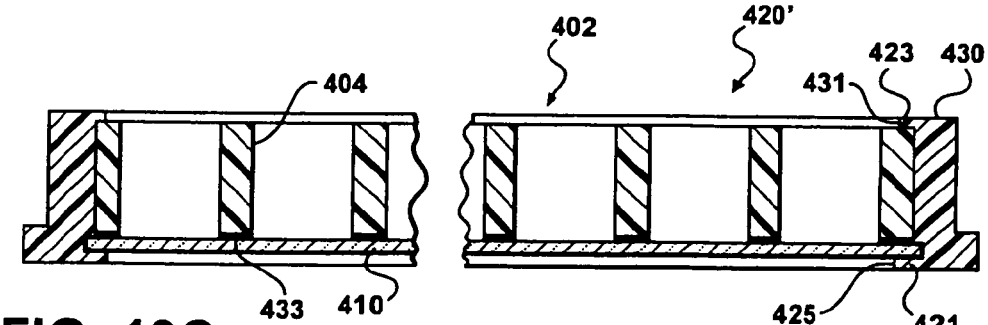
FIG. 13C is a side elevational view, generally similar to FIG. 13B, but showing another modification to the apparatus.

The holder 420' in FIG. 13C is identical to that described above and shown in FIG. 13B. In this aspect of the apparatus, the interconnecting means used to fix the plate 402 in the holder 420' is formed by an inward extending lip or flange 423 formed on the top edge 430 of the holder 420'. The lip 423 forms an inner opening 431 through which the substrate 410 and the plate 402, which may be separately inserted and joined together by an adhesive 433 on one surface of the plate 402 or joined together into a unitary structure outside of the holder 420' and then inserted as a unit into the holder 420' through the aperture 431. The flexible nature of the plate 402 enables it to snap beneath the lip or flange 423. The lip 423 functions to fixedly retain the plate 402 in the holder 420'.

Figure 13D:
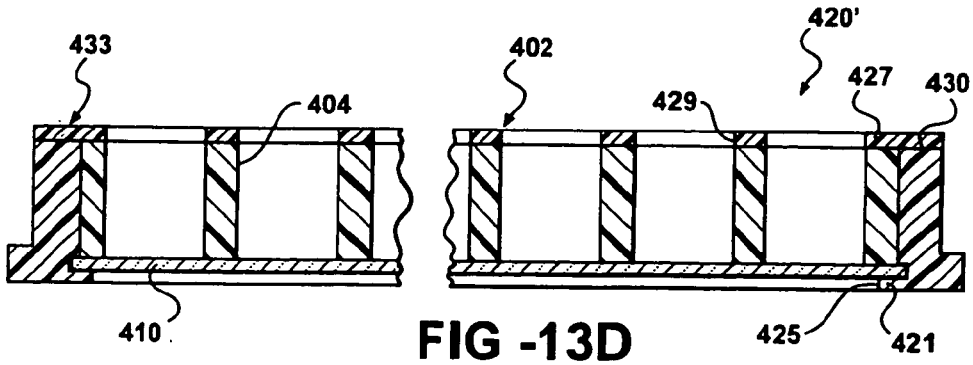
FIG. 13D is a side elevational view, generally similar to FIG. 13B, but showing yet another modification to the apparatus.

In FIG. 13D, the holder 420' also includes the inward extending lip 421 which defines a bottom aperture 422. The inner side walls of the frame or holder 420' are sized to complement the exterior dimensions of the substrate 410 and the plate 402. The plate 402 and the substrate 410 are inserted through an opening in the top surface 430 of the holder 420' until the substrate 410 rests on the inner shoulder of the lip 421. A top plate 433 with a plurality of apertures 435 arranged in the same grid or matrix pattern as the wells 404 in the plate 402 is fixed to the top surface 430 of the holder 420'. The top plate 433 can be made of any suitable material, such as metal, plastic, i.e., polycarbonate, etc. Screws, toggles, hinges or adhesive may be used to removably or non-removably mount the top plate 433 on the holder 420'. The top plate 433 applies pressure to the plate 402 into sealed engagement with the substrate 410 without the need for an adhesive between the facing surfaces of the plate 402 and the substrate 410.

Figure 10:
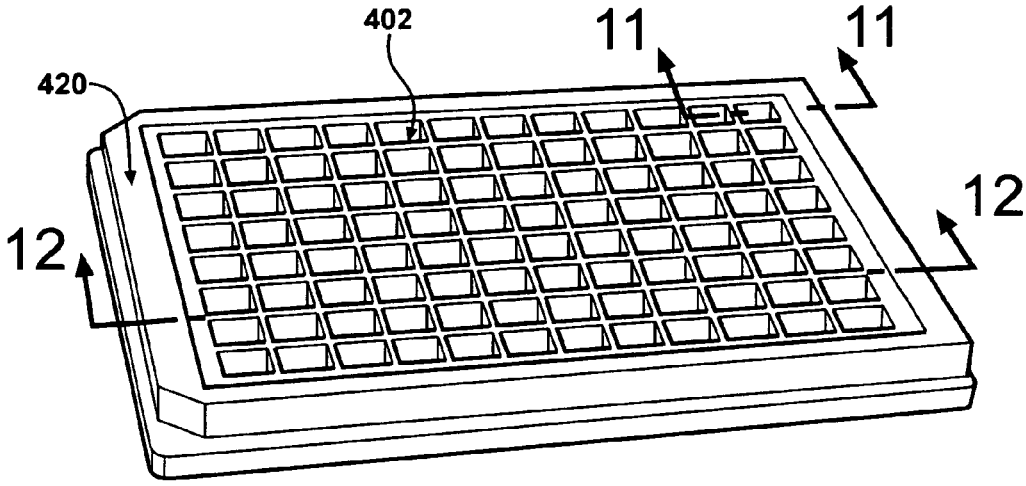
FIG. 10 is an assembled perspective view of the apparatus shown in FIG. 9.
Figure 11:
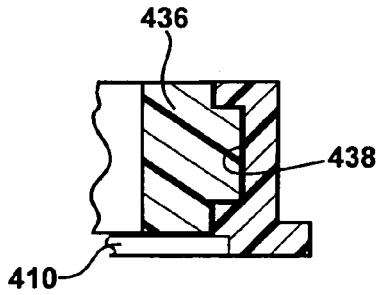
FIG. 11 is a cross-sectional view generally taken along line 11-11 in FIG. 10.
Figure 12:
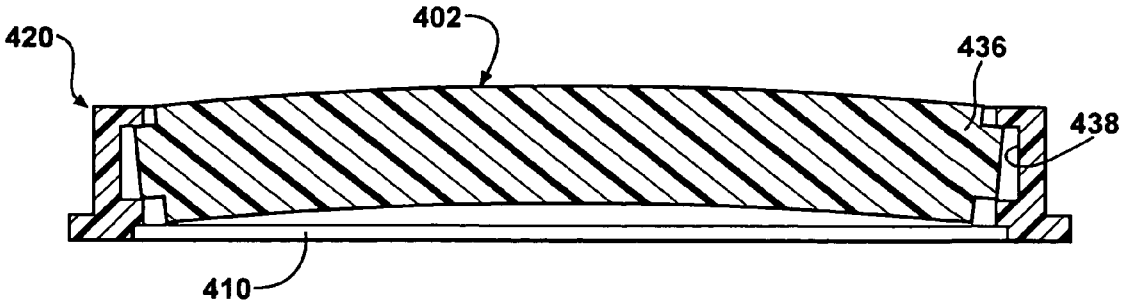
FIG. 12 is a cross-sectional view generally taken along line 12-12 in FIG. 10 and showing the insertion and removal of the flexible microtitre plate from the holder of the apparatus shown in FIGS. 8 and 9.

As shown in FIGS. 11-13A, the plate 402 has sufficient rigidity to enable it to be flexed out of a generally planar nominal position to enable the tab(s) 436 to fit within the interior channels 438 of each of the sides 426 and 428 until the tab(s) 438 are locked in the channels 438 as shown in FIGS. 11-13A. The gasket 402 then returns to its generally planar or flattened shape in the holder 420 as shown in FIGS. 10 and 13A.

By example, the lower or bottom portion of the holder 420 has a laterally outward extending flange 440 which has the exterior dimensions substantially the same footprint of a microtitre plate. This flange 440 is by way of example only as the entire peripheral portion of the holder 420 including each of the sides 422, 424, 426, and 428 may have a planar, solid exterior surface.

A recessed shoulder 442 is formed in the bottom portion 440 of the holder 420 and opens exteriorly through the bottom surface 432 of the holder 420. The recess 442 is sized to receive the substrate 410 in a position to align each reaction surface 408 with one well 404 in the plate 402. Due to the inherent stickiness of the silicone material which can be used to form the gasket or plate 402 or the interacting forces described above, or an external layer of adhesive on one surface of the gasket 402, the gasket 402 seals two and holds the substrate 408 in the holder 420. Each well 404 is sealed about each reaction surface 410 to prevent cross-communication of reaction fluids between wells 404.

The adhesive which may optionally be applied to the bottom surface of the gasket 410 may be a pressure sensitive adhesive. The adhesive may be either non-releasable or releasable.

Figure 14:
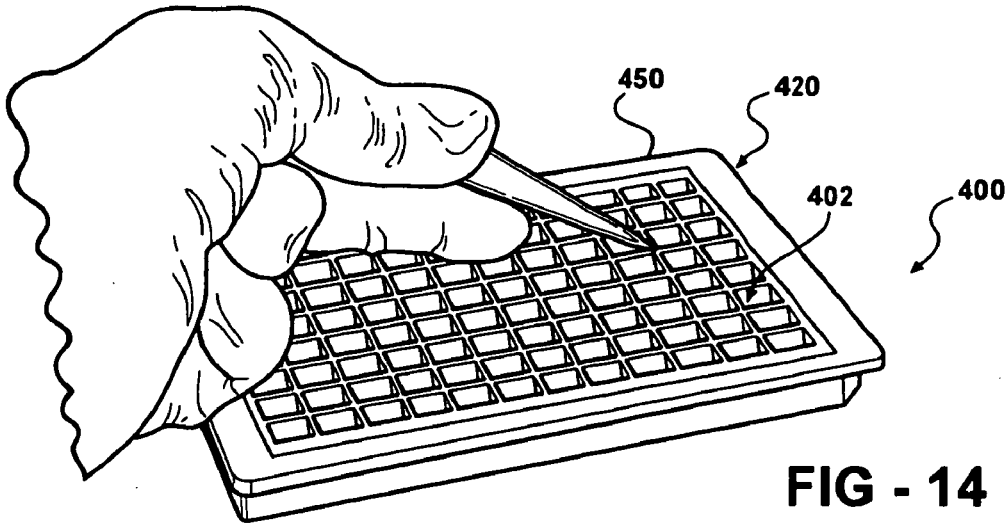
FIGS. 14-16 are perspective views depicting the assembly of the substrate to the holder and the flexible microtitre plate.
Figure 15:
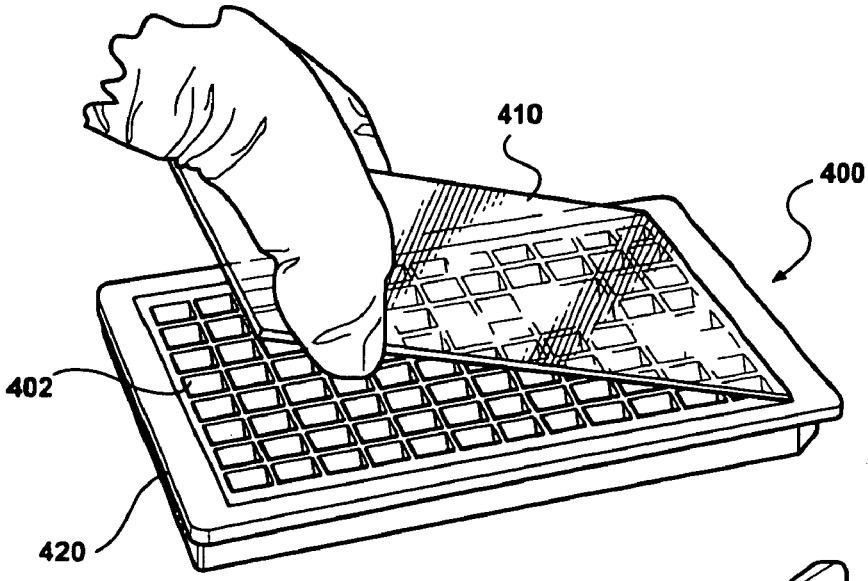
Figure 16:
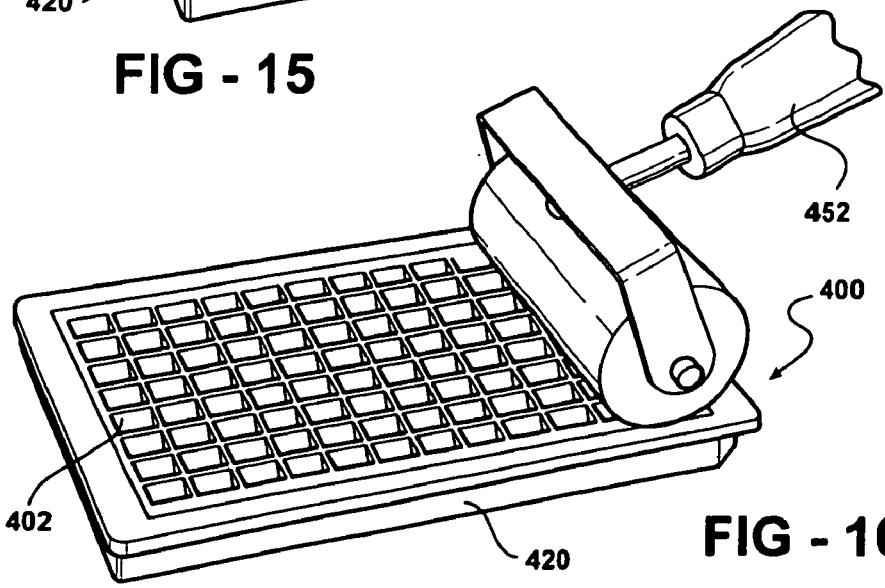

Referring now to FIGS. 14-16, there is depicted an example of a method of using the apparatus 400. First, the gasket 402 is mounted in the holder 420 by interconnection of the tab(s) 436 and the complementary channel(s) 438. The holder 420 is then inverted as shown in FIG. 14 and the optional release liner or protective layer removed from the bottom surface of the gasket 402 to expose the pressure sensitive adhesive or the sticky silicone material bottom surface of the gasket 402.

A substrate formed of one or more plates 402 is then mounted in the holder 420 by insertion of the plate or substrate 402 in the recess 402 in the bottom portion of the holder 420 as shown in FIGS. 13 and 14.

As shown in FIG. 15, a leak proof seal may be enhanced between the substrate 410 and the gasket 402 by the application of pressure, using manual force or a tool, such as a roller 452.

The holder 420 is then reinverted to its normal position with the open end of the wells 404 facing upward. The wells 404 may then be filled with a reagent manually or by robotic fluid handling systems.

After the completion of the reaction, the holder 420 may again be inverted and shaken to remove all liquid contents from the wells 404. During this inversion, the substrate 410 remains held in the holder 420.

During the reaction or storage, the open ends of the wells 404 in the gasket 402 may be sealed or lidded to prevent evaporation of the reagent. The overall structure of the frame or holder 420 facilitates stacking or storage.

The reaction results may be obtained by using conventional scanning equipment suitable for microtitre plates directly through the substrate 410 mounted in the frame 420 with the gasket 402 attached to or removed from the holder 420.

To separate the gasket 402 and the substrate 410 from the frame 420, light pressure is applied to the top surface of the gasket 402 as the holder 420 is pulled up and away from the gasket 402. The gasket 402 may be removed from the substrate 410 by peeling it off starting with one edge as shown in FIG. 4. Removal of the gasket 402 facilitates other types of assay procedures and storage.

In summary, there has been disclosed a unique reaction surface array diagnostic apparatus which utilizes a unique flexible plate having a plurality of wells which form chambers around reaction surfaces carried on a substrate or slide when the plate and the substrate are joined together in a generally rigid holder or frame. The flexible plate and the rigid substrate are separately mountable in the holder or frame. Interconnecting, complementary shaped tabs and channels in the plate and the holder to provide removable mounting of the plate in the holder. The plate is sealingly attachable to the substrate in the holder to form sealed reaction chambers around each reaction surface on the substrate.

What is claimed is:

1. A reaction surface array diagnostic apparatus comprising:

a plate formed of a flexible material having a plurality of wells extending therethrough arranged with standard microtitre plate well spacing; and a rigid frame with an exterior footprint of the standard microtitre plate, the frame including interconnected opposed long sides and opposed short sides, where interior walls of the sides form an interior aperture through the frame, the aperture sized to receive and align the plate and expose the wells in the plate.

2. The apparatus of claim 1 further comprising:

a non-releasable adhesive on a bottom surface of the plate.

3. The apparatus of claim 1 wherein:

the frame has exterior dimensions of about 86 mm×128 mm.

4. The apparatus of claim 1 further comprising:

a releasable adhesive on a bottom surface of the plate.

5. The apparatus of claim 1 wherein:

the plate is formed of a compressible material.

6. The apparatus of claim 1 wherein the interior wall of at least one side at least partially includes a slot, where an open end of the slot faces toward the interior wall of an opposing side from the at least one side having the slot.

7. The apparatus of claim 1 wherein the aperture exposes all the wells in a top surface of the plate.

8. The apparatus of claim 1 wherein a bottom surface of the frame includes a lip extending into the aperture.

9. The apparatus of claim 6 wherein the plate includes a tab shaped to mate with the slot.

10. A reaction surface array diagnostic apparatus comprising:

a plate formed of a flexible material having a plurality of wells extending therethrough arranged with standard microtitre plate well spacing; and a rigid frame with an exterior bottom footprint of the standard microtitre plate, the frame including interconnected opposed long sides and opposed short sides, where interior walls of the sides form an interior aperture through the frame, the aperture sized to receive and align the plate and expose the wells in the plate, the interior wall of at least one side at least partially including a slot recessed with respect to the interior wall of the at least one side, an open end of the slot facing toward the interior wall of an opposing side from the at least one side having the slot, the slot for releasably mounting the plate in the frame, the frame further including a lip extending into the aperture past the interior wall of one of the sides, the lip positioned below the slot.

11. The apparatus of claim 10 wherein the aperture exposes all the wells in a top surface of the plate.

12. The apparatus of claim 10 further comprising:

a non-releasable adhesive on a bottom surface of the plate.

13. The apparatus of claim 10 further comprising:

a releasable adhesive on a bottom surface of the plate.

14. The apparatus of claim 10 wherein the frame has exterior dimensions of about 86 mm×128 mm.

15. The apparatus of claim 10 wherein the plate is formed of a compressible material.

16. The apparatus of claim 10 wherein a side wall of the plate at least partially includes a tab shaped to mate with the slot, where at least a portion of the side wall is recessed with respect to the tab.

17. The apparatus of claim 9, wherein the plate is configured to be flexed out of a generally planar nominal position to enable the tab to fit within the slot, the frame fixedly retaining the plate.

18. A reaction surface array diagnostic apparatus comprising:

a plate formed of a flexible material having a plurality of wells extending therethrough arranged with standard microtitre plate well spacing; and a rigid frame with an exterior bottom footprint of the standard microtitre plate, the frame having a greater amount of rigidity than the plate, the frame including interconnected opposed long sides and opposed short sides, where interior walls of the sides form an interior aperture through the frame, the aperture sized to receive and align the plate and expose the wells in the plate, the interior wall of each short side at least partially including a slot recessed with respect to an upper portion of interior wall of the at least one side, an open end of the slot facing toward the interior wall of an opposing short side from the at least one side having the slot, the plate including a tab shaped to mate with the slot for fixedly retaining the plate in the frame, the frame further including a lip extending into the aperture past the interior wall of one of the sides, the lip positioned below the slot, and wherein the plate is configured to be flexed out of a generally planar nominal position to enable the tab to fit within the slot.

19. The apparatus of claim 18, wherein the plate and the tab are formed of silicon, and the frame having the slot is formed of plastic.

* * * * *